US005335531A

United States Patent [19]

Mann et al.

[11] Patent Number: 5,335,531

[45] Date of Patent: Aug. 9, 1994

[54] COMPRESSION TOOL HEAD ASSEMBLY

[75] Inventors: Steven W. Mann, Mt. Olive; Jerald C. Todd, Birmingham, both of Ala.

[73] Assignee: Square D Company, Palatine, Ill.

[21] Appl. No.: 57,367

[22] Filed: May 4, 1993

[51] Int. Cl.[5] ..... H01R 43/042

[52] U.S. Cl. ..... 72/416; 72/410; 72/401; 29/751

[58] Field of Search ..... 72/416, 410, 409, 453.16, 72/400, 401; 29/751

[56] References Cited

U.S. PATENT DOCUMENTS

| | | | |
|---|---|---|---|
| 3,175,281 | 3/1965 | Elfsten | 72/410 |
| 3,396,571 | 8/1968 | Porter | 72/410 |
| 4,028,756 | 6/1977 | Couto | 72/410 |
| 4,480,460 | 11/1984 | Bush | 72/410 |

FOREIGN PATENT DOCUMENTS

| | | | |
|---|---|---|---|
| 500484 | 3/1954 | Canada | 72/410 |
| 3606429 | 9/1987 | Fed. Rep. of Germany | 29/751 |
| 423868 | 9/1948 | Italy | 72/410 |
| 5398 | 11/1920 | Netherlands | 72/410 |

*Primary Examiner*—Daniel C. Crane

*Attorney, Agent, or Firm*—Larry I. Golden

[57] ABSTRACT

A head assembly for a compression tool including a pair of opposite, rotatably mounted jaw members. Each jaw member having a compression end which is moveable between a first position in engagement with the compression end of the opposite jaw member and a second position wherein the compression ends are spaced apart from each other. The compression end of each jaw member having an interior nib surface, a semi-circular groove surface, an engagement surface and distal compression surface. The head assembly includes a center nib which is operably associated with the interior nib surface of each jaw member to provide three generally equidistant points of contact around the circumference of a connector that is placed therebetween for compression. The two jaws and the center nib form a first compartment, a second compartment and a third compartment in serial alignment, with each compartment adapted to selectively compress a connector and with said engagement surfaces in direct overlapping engagement with each other in response to movement of the jaws to the first position. Each compartment providing multiple areas for deformation flow within the plane of the jaws.

7 Claims, 4 Drawing Sheets

COMPRESSION TOOL HEAD ASSEMBLY

BACKGROUND OF THE INVENTION

1. Field of the Invention

This invention pertains to compression tools and more particularly to a head assembly for a hand operated compression tool adapted for crimping a wide variety of generally smaller sized connectors.

2.Description of the Prior Art

A number of compression tools have been used for compressing metal connectors about electrical conductors to form an electrical and structural connection between two conductors, or between a conductor and a terminal. When two conductors are connected, each conductor end is inserted into an open-end of connector. The connector is then exteriorally compressed by the compression tool to mechanically lock the conductors to the connector and to establish electrical continuity between them. Illustrative of the prior art compression tools is the Bush et al. U.S. Pat. No. 4,480,460, which is owned by the same assignee as identified in the instant application and which patent is hereby specifically incorporated herein by reference.

Although many tools are adapted to crimp a wide range of connectors, there is a need for a tool which will more effectively crimp a wide variety of generally small connectors in the range of numbers 8 through 250 MCM.

SUMMARY OF THE INVENTION

A principle object of the present invention is to provide a single compression tool which will more effectively crimp a wide range of generally small sized connectors.

A further objective of the present invention is to provide a cost effective compression tool which will accommodate various types of crimps for various sized connectors within the small connector range.

Other features and advantages of the invention will become apparent to those skilled in art upon review of the following detailed description, claims and drawings.

DETAILED DESCRIPTION OF THE INVENTION

Figure 1:
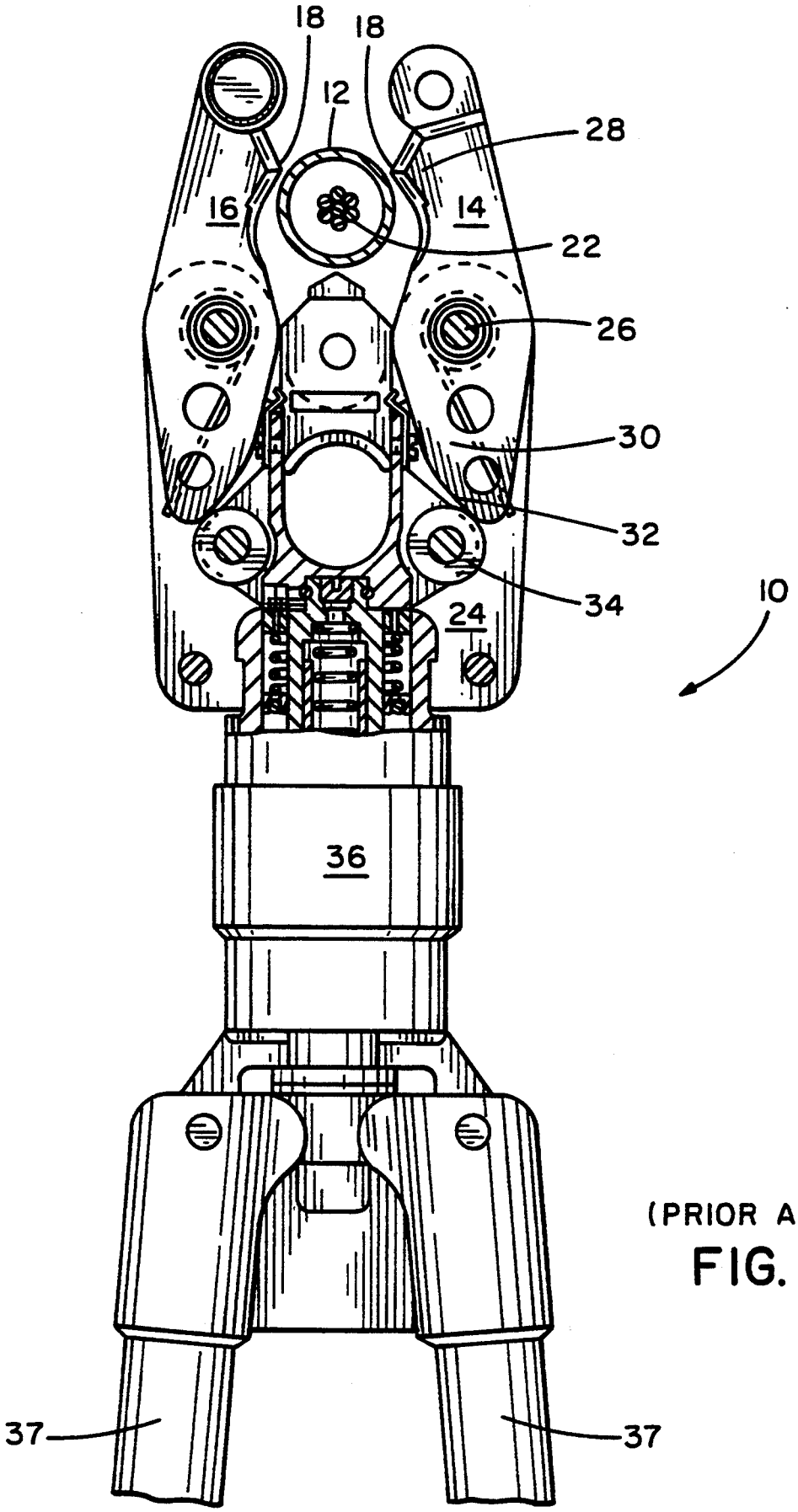
(PRIOR ART) FIG. 1
FIG. 1 is a partial front view of a prior art compression tool which is partly broken away and which reveals a portion of the operating levers, the hydraulic section, and the head section.

Referring to FIG. 1 of the drawings, a hydraulic hand tool 10 found in the prior art is shown in an open position with a connector 12 in position to be compressed.

Figure 2:
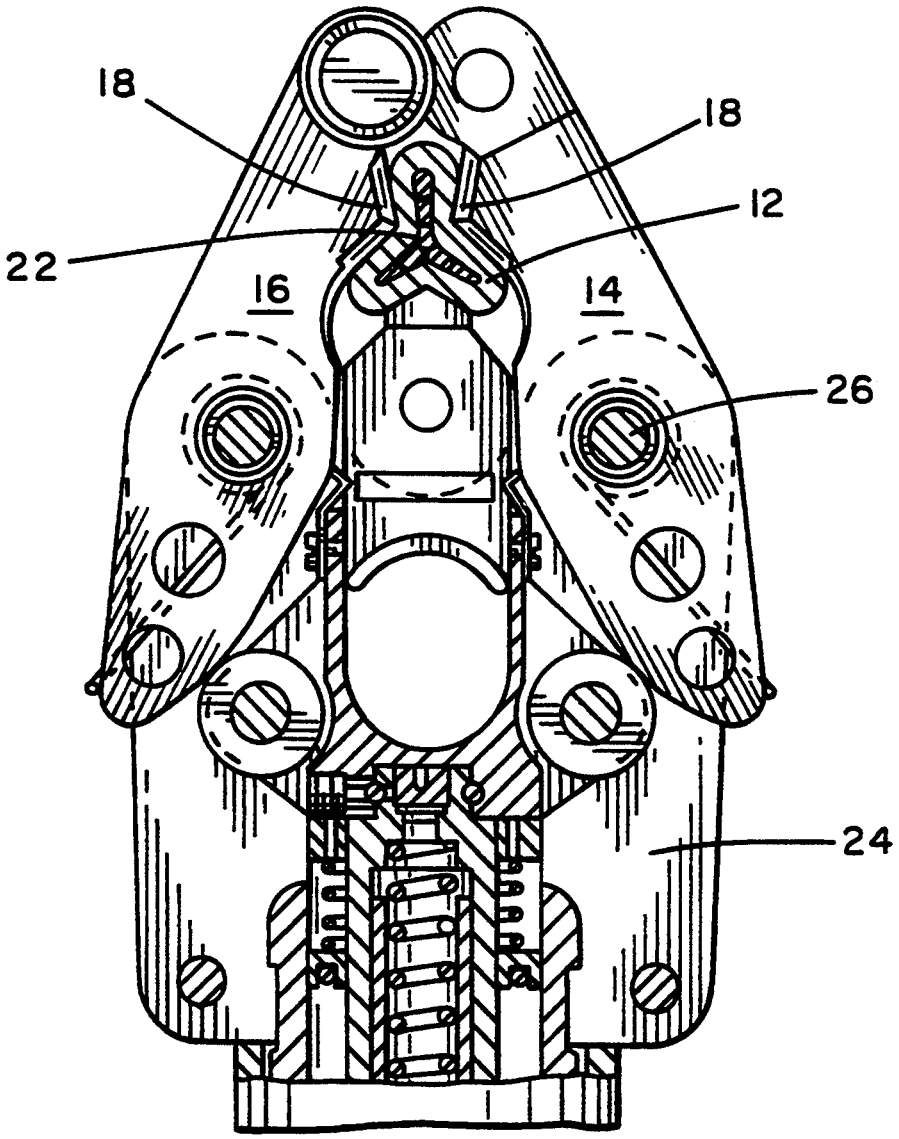
(PRIOR ART) FIG. 2
FIG. 2 illustrates a front view of the prior art tool head shown in FIG. 1 in compression of a cylindrical connector.

FIG. 2 shows the prior tool head in compression of the connector 12. This type of compression tool is in common usage and includes a first side jaw 14 and a second side jaw 16, each with a nib portion 18 extending toward each other to compress the connector against adjacent ends of a pair of conductors 22 that are being connected. The side jaws are rotatably mounted on support members 24 by pins 26.

Each jaw member has a first end 28 adapted to compress the connector and an opposite end 30 having a cam surface 32 adapted to be engaged by rollers 34. The compression tool shown in FIGS. 1 and 2 also includes a hydraulic section 36 and operating levers 37. The compression tool operates in the manner described in previously referenced U.S. Pat. No. 4,480,460 which is specifically incorporated herein by reference.

Figure 3:
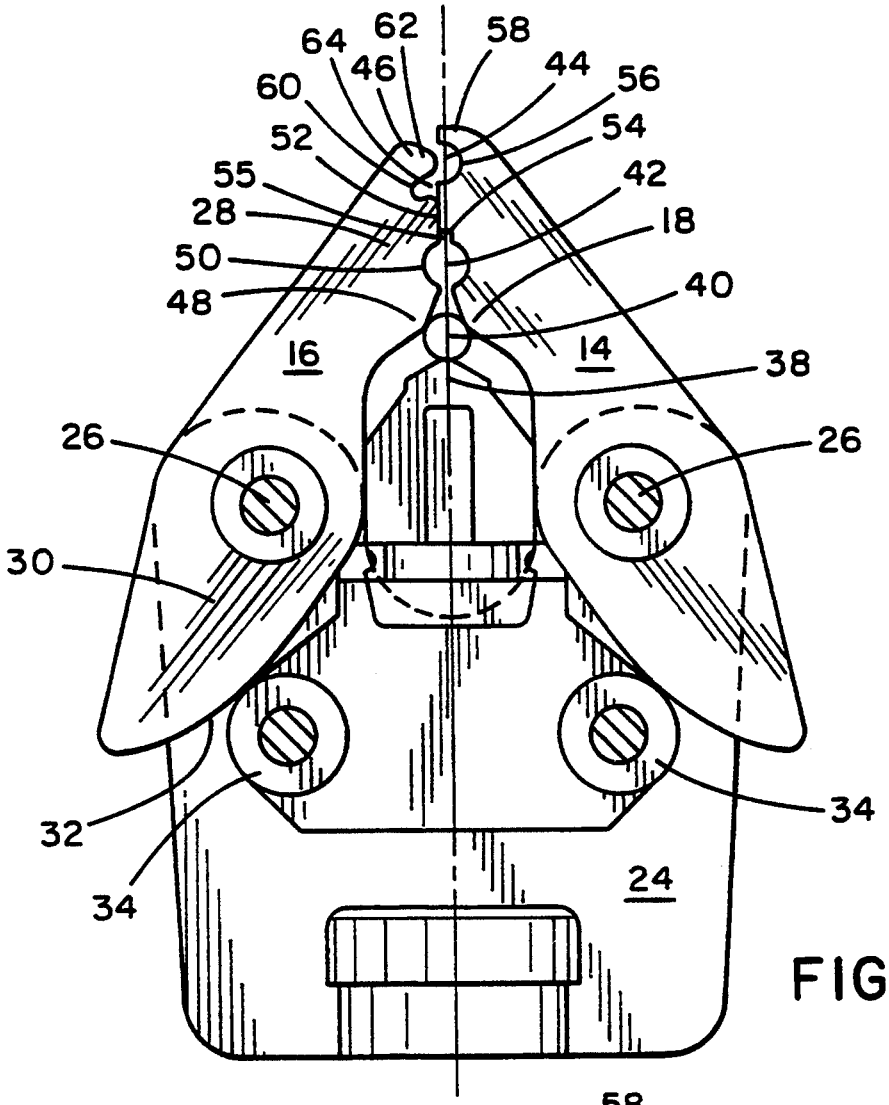
FIG. 3 is a front view of the improved compression tool head.
Figure 4:
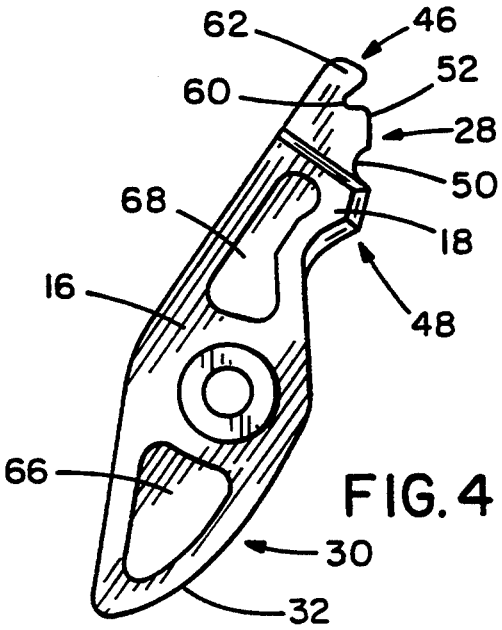
FIG. 4 shows a front view of one of the side jaws utilized in the improved compression tool head.
Figure 5:
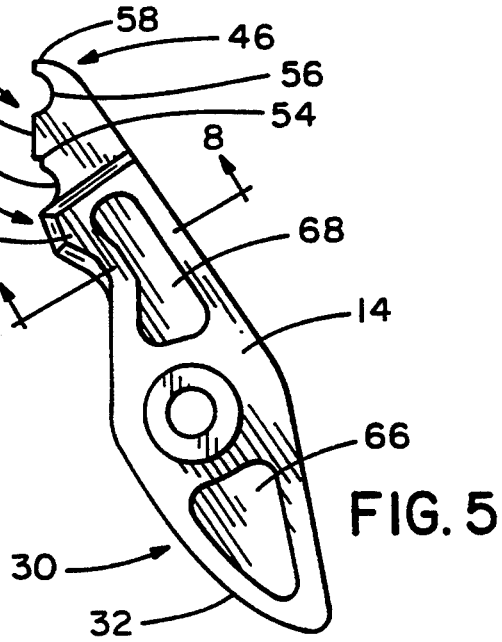
FIG. 5 is a front view of the other side jaw utilized in the improved compression tool head.
Figure 6:
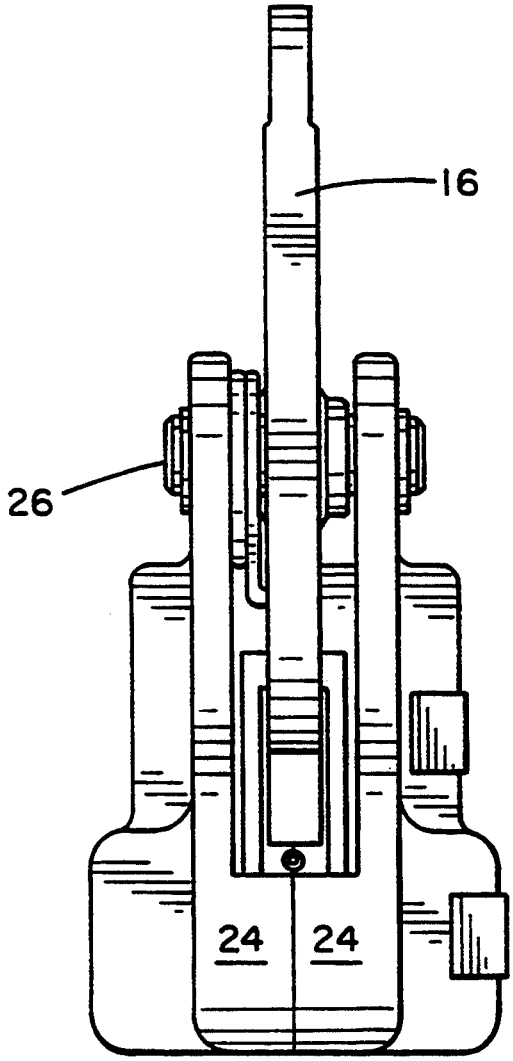
FIG. 6 is a side view showing the side jaw and supporting assembly.
Figure 7:
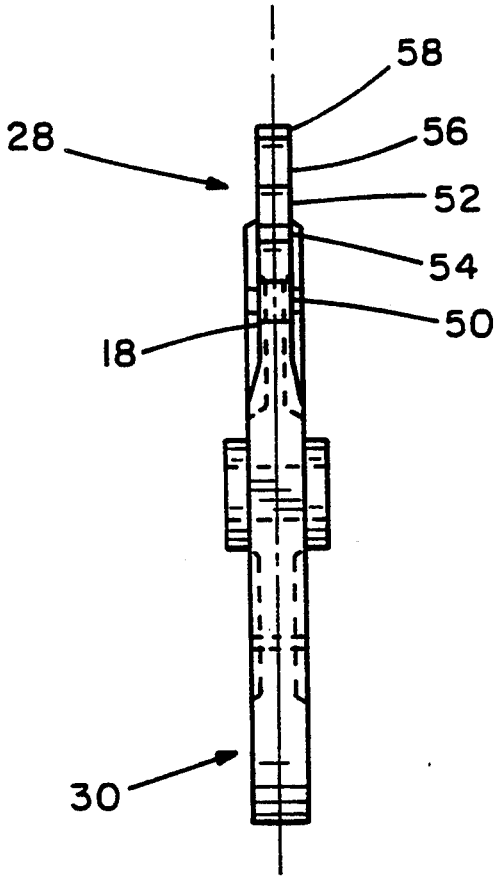
FIG. 7 is a side view of the side jaw shown in FIG. 5.

As perhaps best seen in FIG. 3 of the Drawings, the improved compression tool head assembly includes a substantially modified first side jaw 14 and second side jaw 16 which cooperate with a center nib 38 to provide a first compartment 40, a second compartment 42, and a third compartment 44 in serial alignment of each other when the jaws are in a closed position.

Each of the side jaws are rotatably mounted to the support members 24 by pins 26. Each jaw also includes a first end 28 which is adapted to compress the connectors and an opposite end 30 which includes a cam surface 32 that is engaged by a respective roller 34. The jaws are rotatably mounted for movement between a first position in which the first ends 28 are in engagement in a closed position and a second position in which the first ends 28 are spaced apart in an open position.

The first end of each side jaw, which will be referred to as the compression end, will now be described in further detail. The compression end of each side jaw includes a distal portion 46 at the outward tip of each side jaw and an interior portion 48 inward from the distal portion. Each of the jaws have a nib 18 extending outward from the interior portion with the jaws arranged so that the nibs are urged closed toward a common center point over center nib 38 in response to movement of the side jaws from the second position to the first position corresponding to movement from an open position to a closed or compression position of the tool.

Adjacent the nib in the direction of the distal portion, each side jaws includes a semicircular groove surface 50. Adjacent the groove surface in the direction of the distal portion on each side jaw is an planar engagement surface 52. While the semicircular groove surface transitions directly into the engagement surface on the second side jaw 16, a small step portion 54 is provided between the semicircular groove surface and the engagement surface on the first side jaw 14.

compartment 1 is defined as the area between the three converging nibs and compartment 2 is defined as the area between the opposing semicircular groove surfaces 50, including a notch 55 which is formed by the step portion 54 in abutment with the engagement surface 52 of the second side jaw. It can be seen that even with the side jaws in the fully closed position, compartment 2 is connected to compartment 1.

The distal portion of the first side jaw 14 includes a second semicircular groove portion 56 which forms a finger tip 58 at the end. The distal portion of the second side jaw 16 includes a generally U-shaped groove 60 and a head portion 62 which, together with the distal portion of the first side jaw 14, forms a generally hook or cup-shaped inlet that defines the third compartment at the distal portion of the side jaws.

In the preferred embodiment, with the side jaws in the fully closed position, the two nibs on the side jaws 18 and the center nib 38 define having a 0.300 inch diameter while the distance from the center of the semicircular groove surface 50 of the first side jaw 14 to the center of the semicircular groove surface in the second side jaw 16 is approximately 0.294 inches and the notch has a width of 0.063 inches. The distance from the tip of the head portion 62 to the center of the second groove portion 56 is approximately 0.168 inches while the space between the finger tip 58 and the head portion 62 is 0.113 inches. It should also be noted that a slight offset between the engagement surfaces 52 on the respective side jaws, provides a very small trough area 64 within compartment 3.

Figure 8:
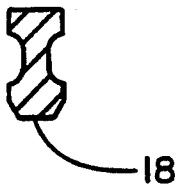
FIG. 8 is a sectional view of the side jaw showing the nib in FIG. 5 taken along lines 8—8.

It has also been found desirable for the side jaw to be provided with a recessed area 66 below the pin position and a recessed area 68 above the pin position to reduce the material that is used. Additionally, as shown in FIG. 8 with respect to one nib. each side jaw is chamfered at the nib to reduce the contact area at the surface of the nib. As shown in FIG. 8, the width of the nib at the top of the cross section figure is 0.375 inches with the bottom portion reduced to 0.250 inches.

The invention is particularly well suited for crimping connectors in the generally smaller sized range. It has been found that the compartment 3 is well suited for providing an indent type crimp in #8 and #6 connectors, compartment 2 is well suited for providing a die type crimp in #4 connectors and compartment 1 is well suited for providing a three-nib indent type crimp in the following sized connectors: 2, 1, 1/0, 2/0, 3/0, 4/0, and 250 MCM.

Each of the compartments provide multiple areas within the plane of the side jaws for deformation flow. As can be seen in FIG. 3 of the Drawings, in the fully closed or compressed position of the jaws, there is space in compartment 1 between each pair of the respective nibs providing a total of 3 directions of flow. Compartment 2 provides two areas, one in the direction of the adjacent nibs and the other in the notch 55 provided by the step portion 54. Compartment 3 also provides the open area between the finger tip 58 and head portion 62 of the respective jaws and also the small trough area 64 toward the bottom of the inlet that defines compartment 3.

It should also be noted that a rectangular slot or opening 39 is provided in the center nib 38 to permit insertion and use of a centering guide (not shown) to position the connector within the compression tool to facilitate a proper crimp.

It is to be understood that the invention is not limited in its application to the details of construction and description set forth above or illustrated in the drawings. The invention is capable of other embodiments and of being practiced or carried out in various other ways. Also, it is to be understood that the phraseology and terminology used herein is for the purpose of description and should not be regarded as limiting.

We claim:

1. A compression tool head assembly including a pair of rotatably mounted, opposite jaw members, each jaw member having a compression end, which is movable between a first position in engagement with the compression end of said opposite jaw member and a second position spaced apart from engagement with the compression end of said opposite jaw member, and an opposite end;

said compression end of each jaw member having a distal portion and an interior portion and at least the following four distinct surfaces:

1) an interior nib surface;

2) a semicircular groove surface;

3) an engagement surface; and 4) a distal compression surface;

said engagement surfaces in direct engagement with each other and said distal compression surfaces forming a generally hook-shaped inlet in response to movement of said jaw members to said first position; and a center nib operably associated with the interior nib surface of each jaw member to provide three generally equidistant points of contact around the circumference of a connector placed therebetween for compression.

2. A compression tool head assembly as claimed in claim 1 wherein said jaws and said center nib form a first compartment, a second compartment and a third compartment in serial alignment, each compartment adapted to selectively compress a connector.

3. A compression tool head assembly as claimed in claim 1 wherein a step portion is provided adjacent the semicircular groove surface to provide a notch in response to movement of said jaw members to said first position.

4. A compression tool head assembly as claimed in claim 2 wherein said first compartment is defined as the area between the three converging nibs, said second compartment is defined as the area between opposing semicircular groove surfaces on the respective side jaws and said first compartment is connected to said second compartment when said jaw members are in said first position.

5. A compression tool head assembly comprising:

a support;

a first side jaw;

a second side jaw;

said first side jaw and said second side jaw rotatably mounted to said support for movement between an open and closed position, each side jaw having s distal portion and an interior portion and a planar engagement surface intermediate said distal and interior portions, said planar engagement surfaces being in slight offset alignment with each other and the only portions of said side jaws in contact with each other in response to movement of said side jaws to said closed position.

each side jaw having a semicircular groove surface adjacent said engagement surface toward said interior portion and a nib portion at the interior portion and a curvilinear portion adjacent said engagement surface at said distal end.

6. A compression tool head assembly as claimed in claim 5 wherein each nib portion includes a chamfered portion forming a reduced contact area surface.

7. A compression tool head assembly as claimed in claim 5 wherein said first side jaw and said second side jaw are each rotatably mounted on a pin, said first side jaw and said second side jaw each including a recessed area on opposite sides of said pin.

* * * * *